US007370910B2

(12) United States Patent
Piretti

(10) Patent No.: US 7,370,910 B2
(45) Date of Patent: May 13, 2008

(54) CHAIR WITH A WRITING TABLET

(75) Inventor: Giancarlo Piretti, Bologna (IT)

(73) Assignee: Pro-Cord SPA, Bologna (IT)

( * ) Notice: Subject to any disclaimer, the term of this patent is extended or adjusted under 35 U.S.C. 154(b) by 374 days.

(21) Appl. No.: 11/003,903

(22) Filed: Dec. 3, 2004

(65) Prior Publication Data

US 2005/0140186 A1 Jun. 30, 2005

(30) Foreign Application Priority Data

Dec. 5, 2003 (EP) ..... 03425787

(51) Int. Cl.
*A47B 39/02* (2006.01)

(52) U.S. Cl. ..... 297/162; 297/239

(58) Field of Classification Search ..... 297/162, 297/239

See application file for complete search history.

(56) References Cited

U.S. PATENT DOCUMENTS

| | | | | |
|---|---|---|---|---|
| 3,784,249 | A * | 1/1974 | Hendrickson et al. | 297/162 X |
| 6,073,997 | A * | 6/2000 | Koh | 297/162 |
| 6,669,282 | B2 * | 12/2003 | Piretti | 297/162 |
| 2003/0030307 | A1 | 2/2003 | Richardson | |

FOREIGN PATENT DOCUMENTS

| | | |
|---|---|---|
| DE | 27 09 262 | 9/1978 |
| DE | 199 05 001 | 8/1999 |
| EP | 0 995 376 | 4/2000 |
| EP | 2002300933 | 10/2002 |
| EP | 1 266 596 | 12/2002 |

OTHER PUBLICATIONS

European Search Report from EP Application No. 03425787, Dated May 12, 2004.

* cited by examiner

*Primary Examiner*—Anthony D. Barfield
(74) *Attorney, Agent, or Firm*—Patterson & Sheridan, LLP

(57) ABSTRACT

A chair comprising a base structure (12) bearing a seat (14), a backrest (16) and a writing tablet (38) movable between a first lowered inoperative position and a raised operative position, in which in the first lowered inoperative position the tablet (38) is parallel to a vertical axis and is inclined relative to a vertical plane parallel to the longitudinal axis of the chair, so that two or more chairs of the same type can be approached longitudinally to each other with the tablets of two adjacent chairs partially superposed on each other. The writing tablet (38) is also provided with a second lowered inoperative position in which the tablet is inclined relative to a vertical axis and is inclined relative to said vertical plane parallel to the longitudinal axis of the chair, so that two or more chairs of the same type can also be superposed vertically on each other with the tablets of two adjacent chairs partially superposed on each other.

18 Claims, 7 Drawing Sheets

CHAIR WITH A WRITING TABLET

CROSS-REFERENCE TO RELATED APPLICATIONS

This application claims benefit of European patent application serial number 03425787.3, filed Dec. 5, 2003, which is herein incorporated by reference.

BACKGROUND OF THE INVENTION

1. Field of the Invention

The present invention generally relates to a relates to a chair with a writing tablet. Chairs of this kind are normally used as sitting stations for participants in conventions, conferences, lectures and the like. The tablet is normally mounted in articulated fashion on the support structure of the chair and it is movable between an inoperative lowered position and an operative raised position in which it forms a bearing plane which allows the occupant to write or to operate a portable computer.

One of the requirements to be met by chairs meant for use for conferences and the like is to able to fit inside each other when the chair are stowed in conditions of non use.

2. Description of the Related Art

The document EP-A-1266596 by the same Applicant describes a chair with a writing tablet according to the preamble of the main claim. The chair described in this document comprises a writing tablet which, in the inoperative lowered position, is parallel to a vertical axis and is inclined relative to a plane parallel to the longitudinal plane of symmetry of the chair, so that two or more chairs of the same kind can be positioned longitudinally close to each other with the tables of two adjacent chairs partially superposed on each other.

The document U.S. Pat. No. 3,712,668 describes a chair with a writing tabled that is movable between a horizontal position and a downward and outward inclined position so that two or more chairs of the same type can be mutually superposed in the vertical direction with the writing tablets of two adjacent chairs partially superposed on each other.

The present invention has the object of providing a chair with a writing tablet which can be vertically superposed or fitted longitudinally within other chairs of the same type. The present invention also has the object of providing an articulation mechanism of the writing tablet that is particularly simple and economical.

SUMMARY OF THE INVENTION

According to the present invention, these objects are achieved by a chair having the characteristics set out in claim 1.

BRIEF DESCRIPTION OF THE DRAWINGS

The present invention shall now be described in detail with reference to the accompanying drawings, provided purely by way of non limiting example, in which:

With reference to FIG. 1, the number 10 designates a chair according to the present invention. The chair 10 comprises a support structure 12 bearing a seat 14 and a backrest 16. The support structure 12 comprises, on each side of the chair 10, a first bar 18 and a second bar 20. The first bar 18 is laterally shifted outwards relative to the second bar 20. The two bars 18,20 are fastened to each other according to a general X configuration. The first bar 18 has a lower portion 22 forming a rear leg of the chair and an upper portion 24 forming a support for an armrest 26. The second bar 20 has a lower portion 26 forming a front leg of the chair and an upper portion 28 forming a support of the backrest 16. The lower portions 22,26 of the bars 18,20 bear respective wheels 30,32.

Figure 1:
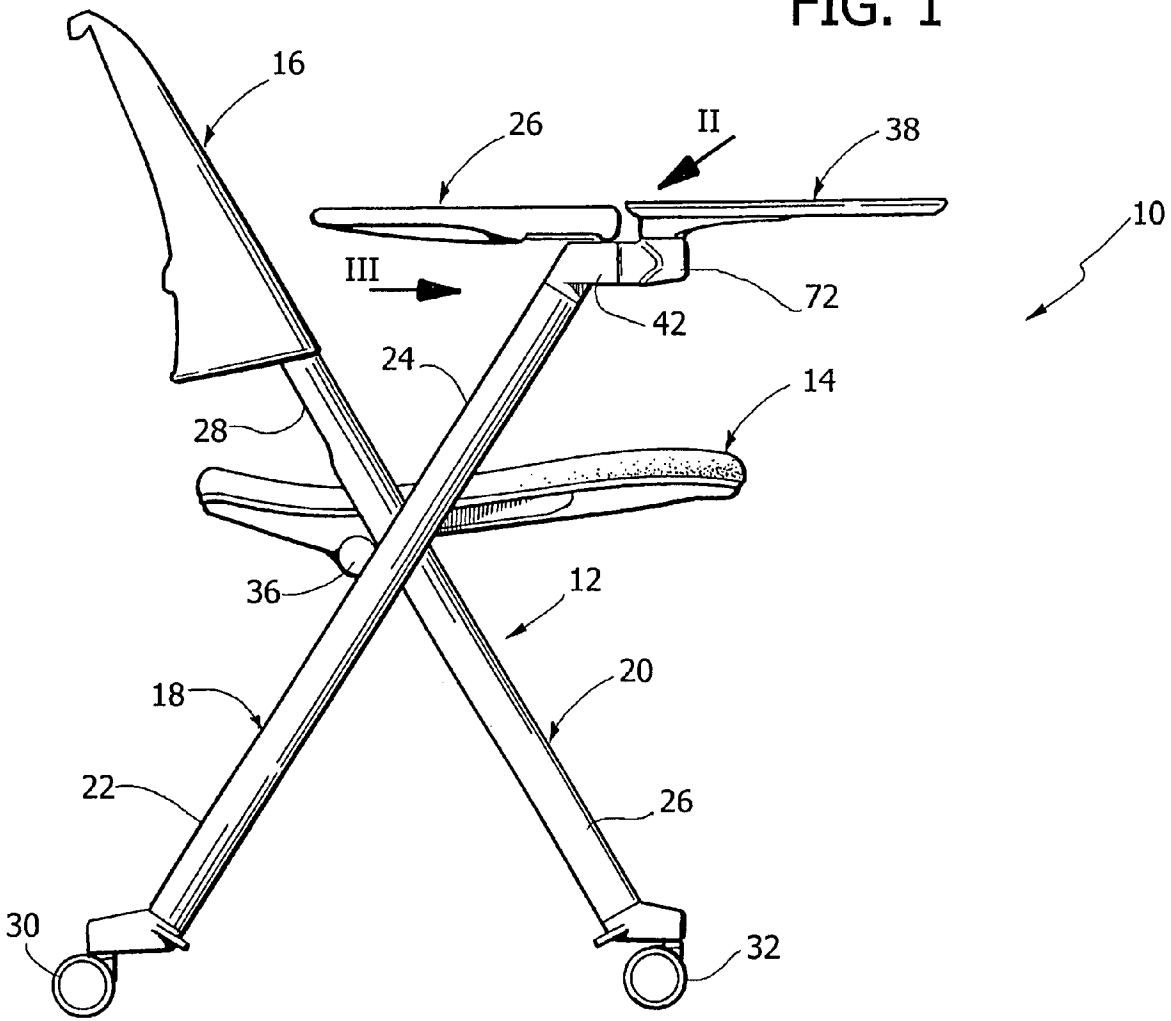
FIG. 1 is a lateral view of a chair according to the present invention.

The seat 14 is articulated to the support structure 12 around a transverse axis 36 orthogonal to the plane of representation of FIG. 1. The seat 14 is movable between the lowered position shown in FIG. 1 and a raised position, not shown.

The upper portion 24 of the first bar 18 bears, in addition to the armrest 26, a writing tablet 38. The support structure 12 of the chair 10, apart from the writing tablet 38, which is only on one side of the chair, is symmetrical relative to a median vertical plane. In the illustrated example, the writing tablet 38 is mounted at the upper end of the bar 18 situated on the right side of the chair 10, since most users are right-handed. The tablet 38 could naturally also be mounted on the left side of the chair 10 without substantial changes to the remaining part of the structure 12.

Figure 2:
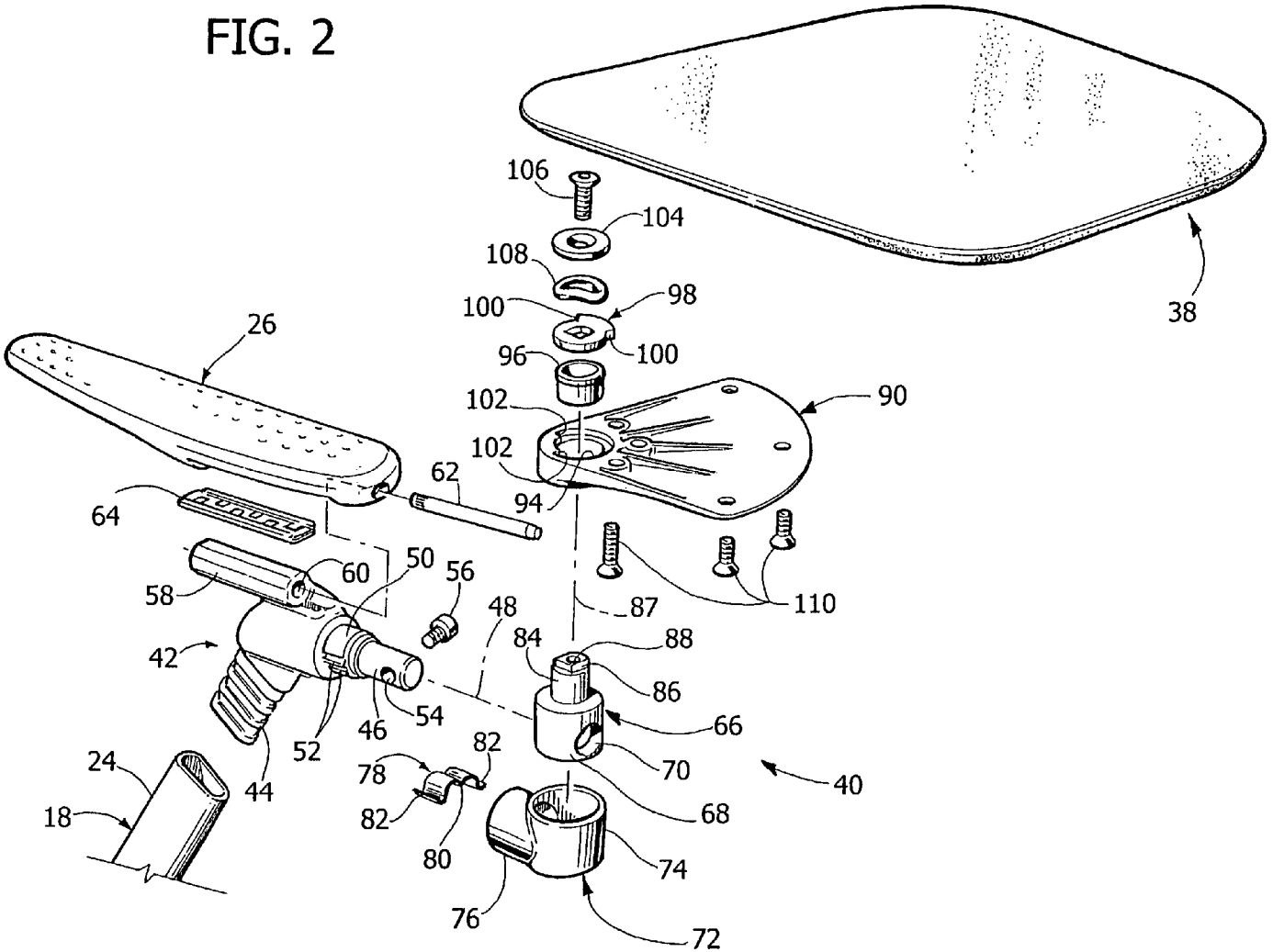
FIG. 2 is an exploded perspective view of the part designated by the arrow II in FIG. 1, FIGS. 3 and 4 are partial views according to the arrow III of FIG. 1 showing the writing tablet in a first and a second inoperative lowered position.

With reference to FIG. 2, the writing tablet 38 is connected to the upper portion 24 of the first bar 18 by means of an articulation device, globally designated by the number 40. The articulation device 40 comprises a stationary support 42 fastened to the upper end of the bar 18. The bar 18 is preferably constituted by an extruded tubular element made of aluminium or similar light alloy. The stationary support 42 has a fastening portion 44 whose profile corresponds to that of the section of the bar 18. The fastening portion 44 of the stationary support 42 is inserted into the open upper end of the bar 18 by slight forcing or with a layer of glue. The stationary support 42 has a pivot projecting in overhang 46, defining a first axis of rotation 48. The pivot 46 is provided with a threaded transverse hole 54 engaged by a screw 56. At the base of the pivot 46 is provided a retaining portion 50 formed by a cylindrical surface with two retaining notches 52, mutually offset in the circumferential direction.

The stationary support 42 is also provided with an integral seating 58, in turn provided with a through hole 60 parallel to the axis 48 of the pivot 46. The through hole 60 of the seat 58 is pivotally engaged by a pivot 62 fastened to the armrest 26. As shall be described hereafter, the armrest 26 can rotate by about 90° relative to the stationary support 42 between a lowered position and a raised position. Preferably, an elastic element 64 is positioned between the surfaces in relative motion of the armrest 26 and of the seating 58.

The articulation device 40 comprises a metallic rotary body 66 mounted on the pivot 46 of the stationary support 42 and able to rotate around the first axis of rotation 48. The rotating body 46 has a cylindrical head 68 having a through hole 70 into which is pivotally inserted the pivot 46. The head 68 of the rotating body 46 has an opening (not visible in the representation of FIG. 2) that is transverse relative to the axis of the hole 70 and with two abutment surfaces positioned substantially at 90° from each other. The screw 56 extends through said opening and defines two end stop positions of the rotary body 66 relative to the stationary support 42, positioned substantially at 90° from each other. The screw 56 also constitutes a stop which prevents the axial extraction of the rotary body 66 relative to the pivot 46.

The articulation device 40 comprises a covering member 72, preferably made of injected plastic material, having two cylindrical portions 74,76 positioned transversely relative to each other. The first cylindrical portion 74 receives the head 68 of the rotary body 66. The second cylindrical portion 76 receives in its interior an elastic retaining member formed by a substantially M shaped metal lamina, having a pointed central portion 80 and two lateral portions 82. The lateral portions 82 engage respective grooves formed on the inner walls of the second cylindrical portion 76. The second cylindrical portion 76 pivotally engages the cylindrical surface of the retaining portion 50 of the stationary support 42. The pointed central portion 80 of the elastic retaining member 78 engages the retaining notches 52 of the retaining portion 50 to define two stable retaining positions.

The rotary body 66 has an integral pivot shaped portion 84 whose axis defines a second axis of rotation 87 which extends transversely relative to the first axis of rotation 48. The pivot shaped portion 84 of the rotary body 66 has an end with square section 86 and a threaded axial hole 88.

The writing tablet 38 comprises a metallic support plate 90 provided with a hub 92 with a through hole 94. A plastic bushing 96 is inserted in the through hole 94. The inner surface of the bushing 96 pivotally engages the outer surface of the pivot shaped portion 84 of the rotary body 66. An arresting element 98 is mounted on the square sectioned end 86 of the pivot shaped portion 84. The arresting element 98 has two arresting surfaces 100 which co-operate with corresponding arresting surfaces 102 formed on the hub 92 of the support plate 90. The arresting element 100 is fastened to the pivot shaped portion 84 of the rotary body 66 by means of a metallic washer 104 and a screw 106 which engages the threaded hole 88. An undulated elastic ring 108 is preferably positioned between the washer 104 and the arresting element 98.

The support plate 90 is fastened to the writing tablet 38 by means of screws 110. The support plate 90 can rotate around the second axis of rotation 86 between two end stop positions defined by the contact positions between the surfaces 100 of the arresting element 98 against the corresponding surfaces 102 of the support plate 90. The support plate 90 and the writing tablet 38 fastened thereto are free to effect a rotation movement around the second axis of rotation 86 with an angular extension of about 180°.

Figure 5:
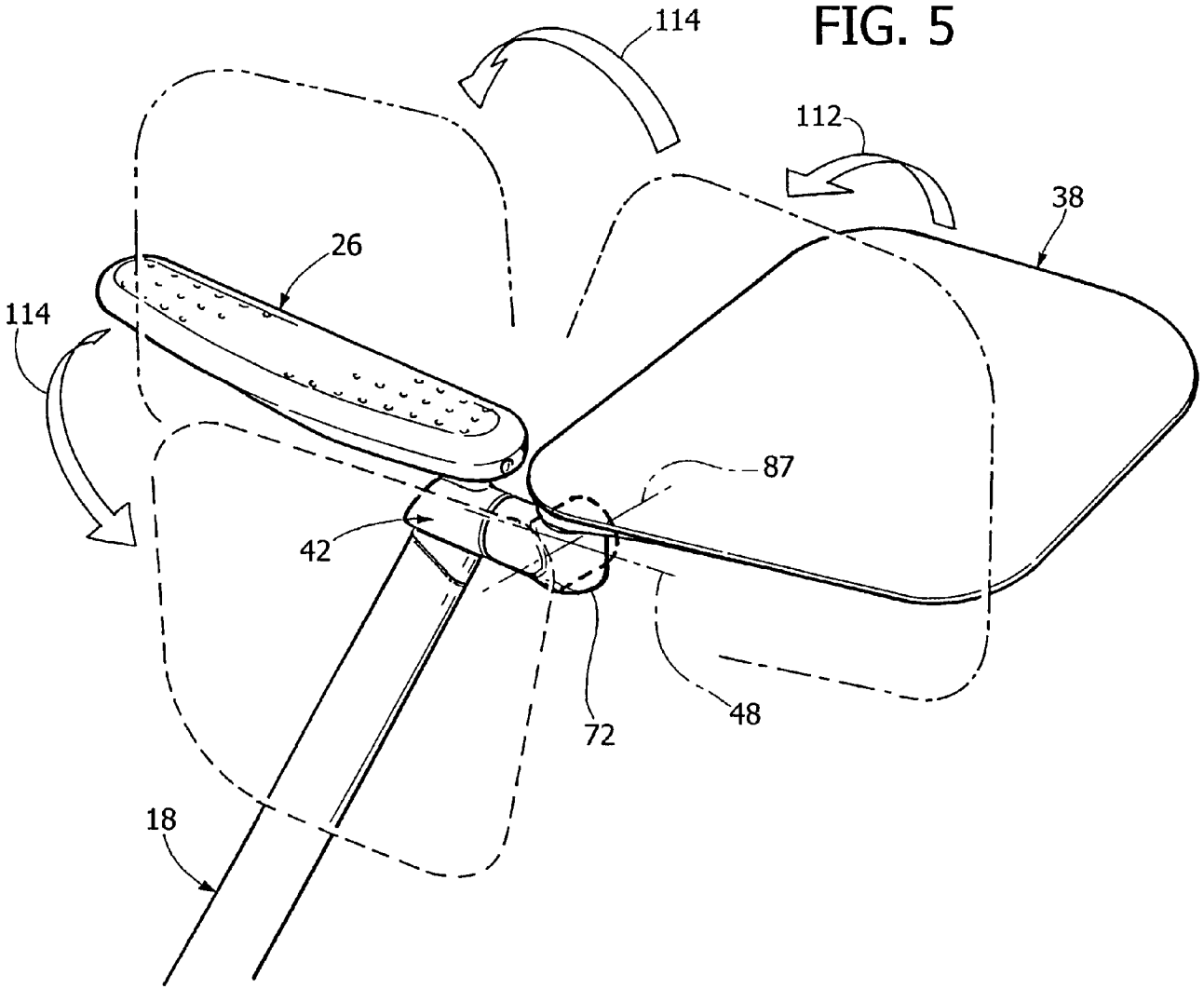
FIG. 5 is a perspective view showing the sequence of motion of the writing tablet according to the present invention.

With reference to FIG. 5, the articulation device 40 described above allows to move the writing tablet 38 between a raised operative position and two lowered inoperative positions, and vice versa. Starting from the operative position shown with solid line in FIG. 5, the writing tablet 38 is first raised with a rotation of about 90° around the first axis of rotation 48 in the direction indicated by the arrow 112, until it reaches an end stop position. Then, the tabled 38 is made to rotate by about 180° around the second axis of rotation 87 in the direction indicated by the arrows 114, until it reaches an end stop position. To pass from an inoperative lowered position to the operative raised position, the previously described movements are performed in reverse order.

Figure 7:
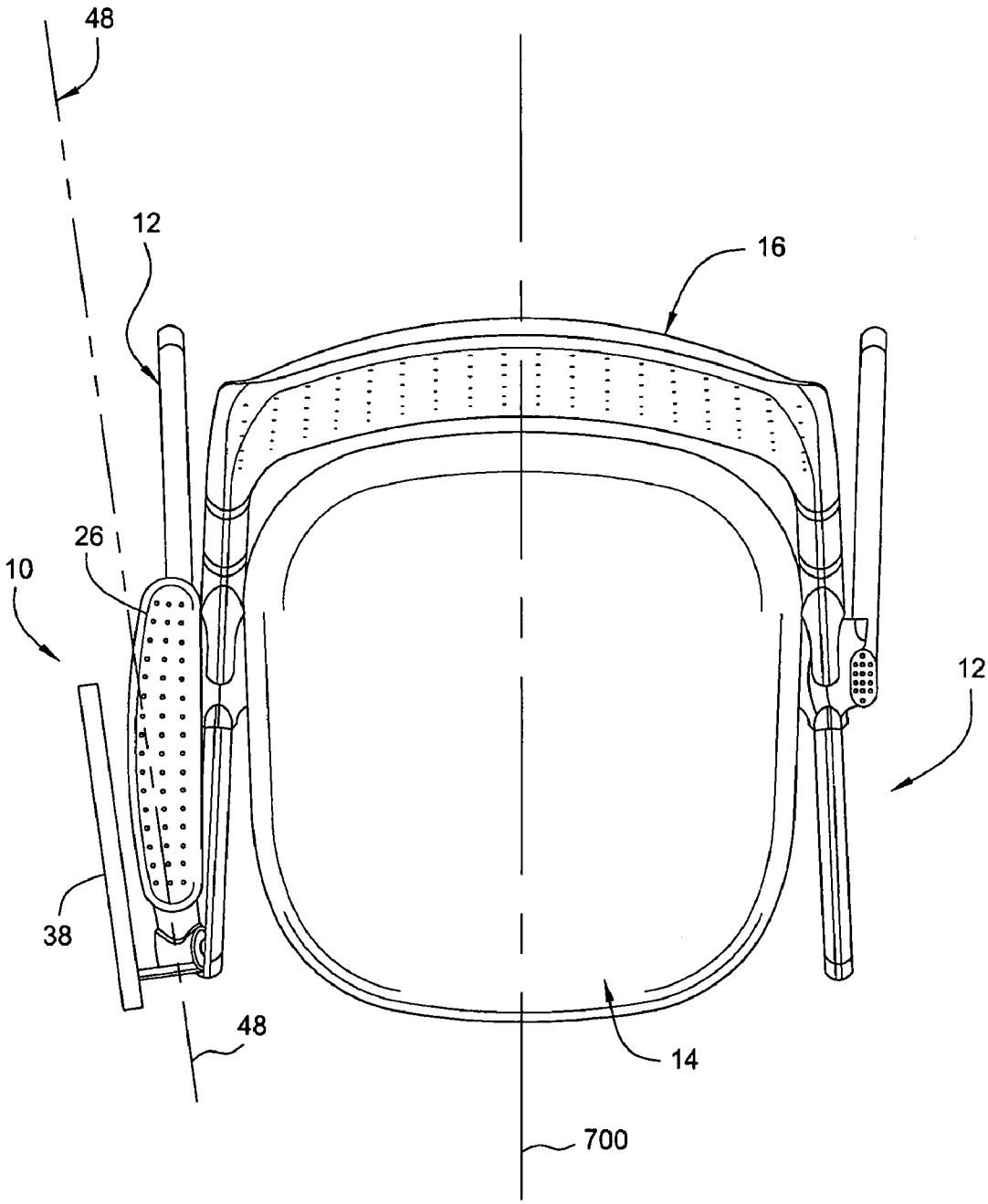
FIG. 7 is a top view of a chair according to the present invention.

The first axis of rotation 48 is substantially horizontal and it is inclined relative to a longitudinal axis 700 of the chair, as shown in FIG. 7. In particular, the axis 48 is inclined from the exterior towards the interior of the chair in the direction that goes from the rear part to the front part of the chair.

Figure 8:
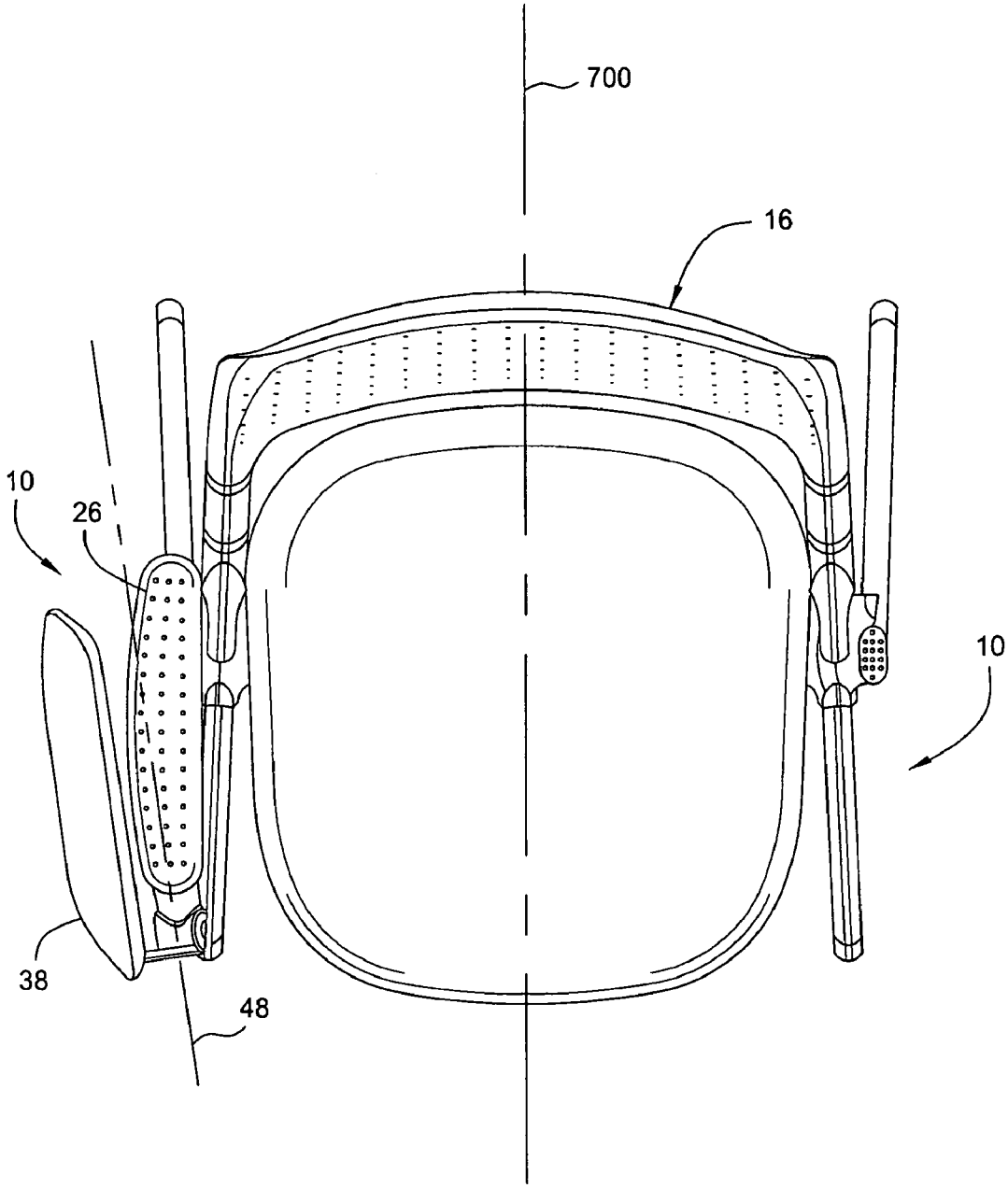
FIG. 8 is a top view of a chair according to the present invention.

Because of the inclined position of the first axis of rotation 48, the writing tablet 38 is inclined, in an inoperative lowered position, relative to a vertical plane parallel to the longitudinal axis 700 of the chair, as shown in FIGS. 7 and 8.

Figure 3:
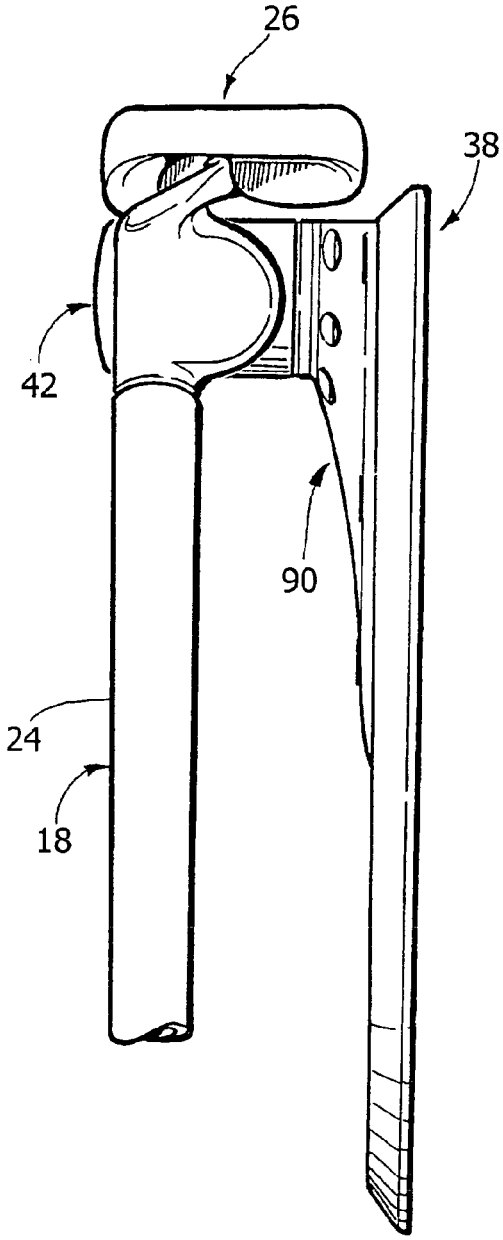
Figure 4:
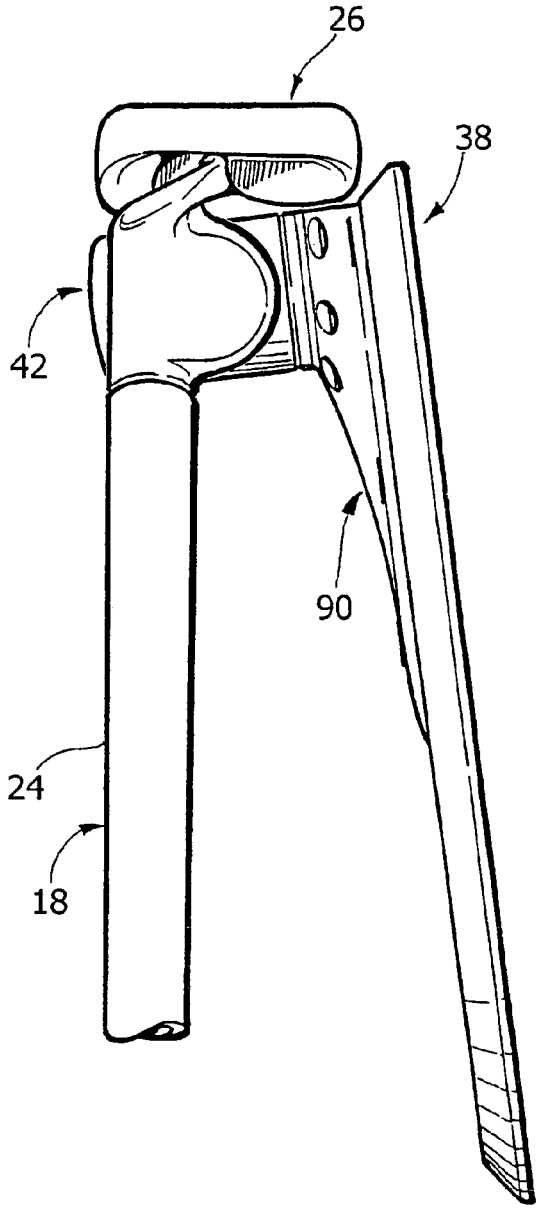

With reference to FIGS. 3 and 4, the articulation device 40 described above enables the writing tablet 38 to assume a first and a second inoperative lowered position. In the first inoperative lowered position shown in FIG. 3 and FIG. 7, the writing tablet 38 is parallel or substantially parallel relative to a vertical axis and it is also inclined relative to a vertical plane, parallel to the longitudinal axis 700 of the chair. In the second inoperative lowered position shown in FIG. 4 and FIG. 8, the writing tablet 38 is inclined relative to a vertical axis and it is also inclined relative to a vertical axis parallel to the longitudinal axis 700 of the chair. The tablet 38 is stably held in each of the two inoperative positions shown in FIGS. 3, 4, 7 and 8 by the engagement of the pointed part 80 of the elastic element 78 with one of the two retaining notches 52 provided on the retaining portion 50 of the stationary support 42. To move the tablet 38 from one of the stable retaining positions of FIGS. 3, 4, 7 and 8, the user will have to apply a sufficient torque to make the tip of the elastic element 78 come out of its engagement with the respective positioning notch 52.

Figure 6:
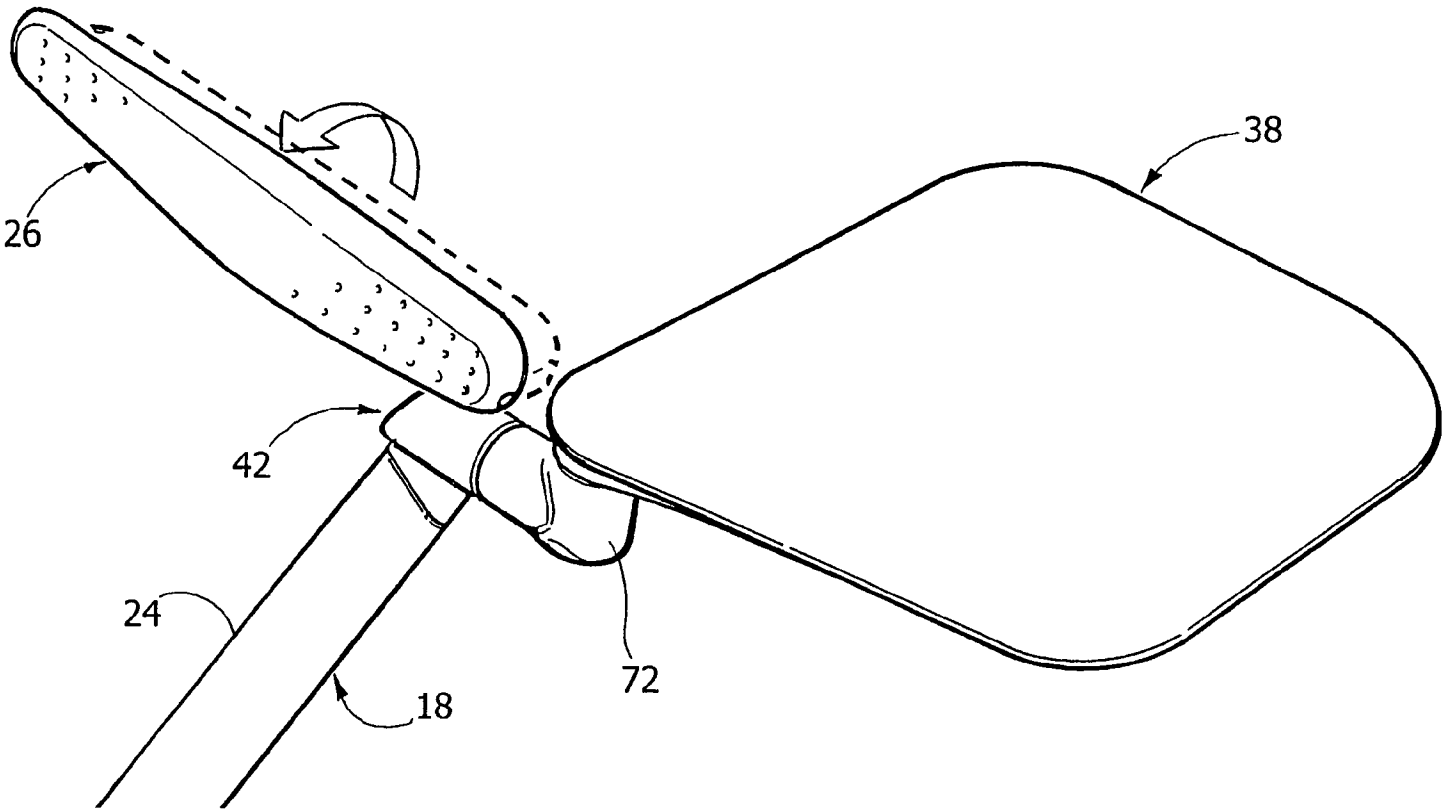
FIG. 6 is a perspective view showing the rotating movement of the armrest.

As shown in FIG. 6, each of the two armrests 26 of the chair is able to rotate by about 90° around an axis parallel to the first axis of rotation 48, between an operative lowered position shown with dashed line and an inoperative raised position shown with solid line.

The support structure 12 of the chair 10 is so shaped as to allow two or more chairs of the same type to be fitted within each other in the longitudinal direction and also superposed in the vertical direction. To fit two or more chairs of the same type within each other in the longitudinal direction, the writing tablet is placed in the inoperative position shown in FIG. 3. The armrests 26 are placed in raised position and the seat 14 is raised. In this condition, two or more chairs of the same type can be fitted within each other in the longitudinal direction. The tablet 38 of the front chair is positioned externally and in partially superposed position relative to the tablet 38 of the rear chair. The front legs 26 of the rear chair are positioned between the rear legs 22 of the front chair and the portions 28 supporting the backrest of the front chair are positioned between the portions 24 supporting the armrests of the rear chair. The armrests 26 of the front chair are positioned externally and in partially superposed position relative to the armrests 26 of the rear chair.

To superpose two chairs of the same type on each other in the vertical direction, the tablets 38 of the two chairs are placed in the same inoperative position shown in FIG. 4. The armrests 26 are placed in raised position and the seats 14 are placed in lowered position. In this configuration, the tablet 38 of the upper chair is positioned externally and in partially superposed position relative to the tablet 38 of the lower chair. The bars 20 of the upper chair are placed above the bars 20 of the lower chair and the bars 18 of the upper chair are positioned above the bars 18 of the lower chair.

DETAILED DESCRIPTION

While the foregoing is directed to embodiments of the present invention, other and further embodiments of the invention may be devised without departing from the basic scope thereof, and the scope thereof is determined by the claims that follow.

The invention claimed is:

1. A chair comprising:

a base structure bearing a seat, a backrest and a writing tablet, wherein the writing table is movable between a first lowered inoperative position and a raised operative position, in which in the first lowered inoperative position a top writing surface of the writing tablet is parallel to a vertical axis and the top writing surface is inclined horizontally relative to a vertical plane parallel to a longitudinal axis of the chair, so that two or more chairs of the same type can be approached longitudinally to each other with the writing tablets of two adjacent chairs partially superposed on each other;

a first axis of rotation, wherein the first axis of rotation is substantially horizontal and at an angle relative to the longitudinal axis of the chair; and the writing tablet being also provided with a second lowered inoperative position in which the top writing surface of the writing tablet is inclined relative to a vertical axis and the top writing surface is inclined horizontally relative to said vertical plane parallel to the longitudinal axis of the chair, so that two or more chairs of the same type can also be superposed vertically on each other with the tablets of two adjacent chairs partially superposed on each other, wherein the writing table is pivoted about the first axis of rotation when moved between the first lowered inoperative position and the second lowered inoperative position.

2. A chair as claimed in claim 1, wherein the writing tablet is borne by an articulation device having the first axis of rotation parallel to the plane of the tablet and a second axis of rotation orthogonal to the plane of the tablet.

3. A chair as claimed in claim 2, wherein the articulation device comprises retaining means to hold the tablet in two stable positions corresponding to the first lowered inoperative position and to the second lowered inoperative position.

4. A chair as claimed in claim 3, wherein the articulation device comprises a stationary support provided with a pivot defining said first axis of rotation and whereon is pivotally mounted a body having a pivot shaped portion defining said second axis of rotation.

5. A chair as claimed in claim 4, wherein the articulation device comprises a covering element bearing an elastic lamina co-operating with a pair of retaining notches formed on a retaining portion of said stationary support.

6. A chair as claimed in claim 4, wherein the writing tablet is fastened to a support plate provided with a through hole which pivotally engages said pivot shaped portion of said rotary body, an arresting element being fastened to an end of said pivot shaped portion.

7. The chair as claimed in claim 5, wherein the retaining portion is configured to retain the writing table in each of the first lowered inoperative position and the second lowered inoperative position.

8. A chair as claimed in claim 1, wherein the support structure comprises, on each side of the chair, a first bar and a second bar fastened to each other according to a general X configuration, the first bar and the second bar being distanced from each other in the lateral direction.

9. A chair as claimed in claim 8, wherein the first bar has a lower portion forming a rear leg and an upper portion forming a support for an armrest, and in that the second bar has a lower portion forming a front leg and an upper portion forming a support for the backrest.

10. A chair as claimed in claim 9, comprising an armrest on each side of the chair, each armrest being able to rotate around a horizontal axis between a lowered operative position and a raised inoperative position.

11. The chair as claimed in claim 10, wherein the armrest is configured to move independently of the writing table and the horizontal axis is parallel with the longitudinal axis of the chair.

12. A chair, comprising:

a seat;

a backrest;

a support structure for supporting the seat and the backrest;

a writing table wherein the writing table is configured to move between three positions, the three positions comprising:

a raised operative position wherein the writing table is in a position allowing a user sitting on the chair to write on the writing table;

a first inoperative position wherein a top writing surface of the writing table is substantially parallel to a vertical axis and the top writing surface is at an angle relative to a vertical plane through a center line of the seat and the backrest;

a second inoperative position wherein the top writing surface of the writing table is at an angle relative to the vertical axis and the top writing surface is at an angle relative to a vertical plane through a center line of the seat and the backrest, wherein the writing table rotates about a first axis of rotation between the first inoperative position and the second inoperative position, the first axis of rotation being substantially horizontal and positioned at an angle relative to a longitudinal axis of the chair; and a retaining portion configured to hold the writing table in the first inoperative position and the second inoperative position.

13. The chair of claim 12, wherein the retaining portion further comprises an elastic retaining member configured to engage one or more retaining notches.

14. The chair of claim 12, further comprising an arm rest configured to provide support for a users arm and wherein the writing table is configured to move independently from the arm rest.

15. The chair of claim 14, wherein the arm rest is configured to move between an arm support position wherein the arm rest is in alignment with the writing table when the writing table is in the raised operative position and a vertical position wherein a top surface of the arm rest is substantially vertical.

16. The chair of claim 15, further comprising a second arm rest located on the opposite side of the chair from the writing table and configured to support the users non-writing arm.

17. The chair of claim 12, wherein the writing table rotates only about the first axis of rotation when the writing table is moved between the first inoperative position and the second inoperative position.

18. The chair of claim 12, wherein the angle between the first axis of rotation and the longitudinal axis of the chair is configured to increased the distance the writing table is from the seat from a front end of the writing table to a rear end of the writing table when the writing table is in the first inoperative position and the second inoperative position.

* * * * *